United States Patent [19]

More-Chevalier

[11] Patent Number: 4,653,202

[45] Date of Patent: Mar. 31, 1987

[54] MOVABLE DRYER FOR THE TREATMENT OF LUMBER PRODUCTS

[75] Inventor: François More-Chevalier, Paris, France

[73] Assignee: Cat'hild, Paris, France

[21] Appl. No.: 826,257

[22] Filed: Feb. 5, 1986

[51] Int. Cl.[4] ..... F26B 9/02

[52] U.S. Cl. ..... 34/201; 34/218; 34/229; 34/243 R; 432/33; 432/88

[58] Field of Search ..... 432/33, 88; 34/222, 34/229, 201, 218, 236, 243 R

[56] References Cited

U.S. PATENT DOCUMENTS 3,765,104 10/1973 Takeuchi ..... 34/229

*Primary Examiner*—Larry I. Schwartz

*Attorney, Agent, or Firm*—Burns, Doane, Swecker & Mathis

[57] ABSTRACT

A movable dryer for lumber products comprising a housing able to be displaced on rails secured to a slab and provided with a first roller bearing on the ground. A first motor is mounted on the housing and actuates a lifting jack which imparts a vertical movement to the housing. A second motor is mounted on the housing and actuates the first roller. A second roller assembly bears on the rails and is integral with the lifting jack. Provision is made for a fan for circulating the air through the housing and a heating device for supplying the required thermic operating gradient to the dryer. A control is provided for controlling the aforesaid dryer operations, thus enabling the dryer to be moved from a first resting location to a second one.

9 Claims, 5 Drawing Figures

MOVABLE DRYER FOR THE TREATMENT OF LUMBER PRODUCTS

TECHNICAL FIELD OF THE INVENTION

The invention relates to a movable dryer especially usable for drying lumber products.

BACKGROUND OF THE ART

A great deal of work has been directed to the drying of lumber products. Usually, the lumber products are stacked while providing the air passage by locating spacers between adjacent lumber products. Almost all of the drying methods involve at least two drying steps. Use is commonly made of large-sized buildings provided with heaters and fans. In fact such dryers did not provide good results due to the non-uniform circulation of the heated air through the stacks of lumber products. Further methods require a plurality of handling steps of selection of the lumber products which leads to expensive costs when operated.

OBJECTS AND SUMMARY OF THE INVENTION

An object of the invention is to obviate some of the major disadvantages of the dryers of the prior art.

It is another object of the invention to provide a dryer which may be moved with respect to the lumber products to be dried.

In accordance with one aspect of the invention, there is provided:

- a housing able to be displaced on rails secured to a slab and provided with first rolling means bearing on the ground;
- first motor means mounted on the housing and intended to actuate lifting means which impart an upward-downward movement to the housing;
- second motor means mounted on the housing and intended to actuate the first rolling means;
- second rolling means bearing on the rails and integral with the lifting means;
- fan means for circulating the air through the housing;
- heating means for supplying the required thermic operating gradient to the dryer and
- control means for controlling the aforesaid means, thus enabling the dryer to be moved from a first resting location to a second one.

BRIEF DESCRIPTION OF THE DRAWINGS

While the specification concludes with claims particularly pointing out and distinctly claiming the present invention, it is believed that the same will be better understood from the following description taken in conjunction with the accompanying drawings in which:

DETAILED DESCRIPTION OF THE PREFERRED EMBODIMENT

Figure 1:
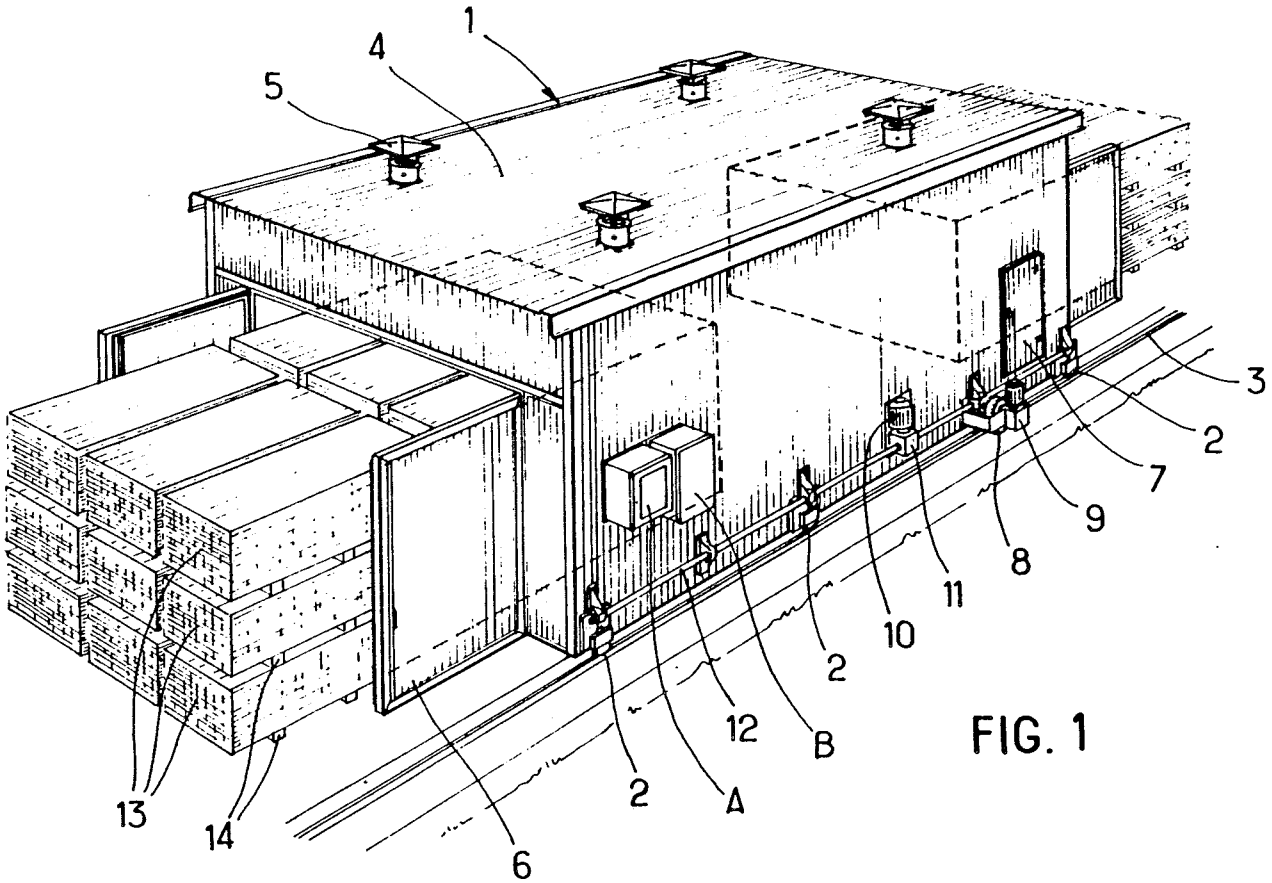
FIG. 1 is a perspective view of a preferred embodiment of the movable dryer of the invention.

Referring now to the drawings in detail, wherein like numerals indicate the same elements throughout the views, there is illustrated a preferred embodiment of a movable drier of the present invention. The dryer comprises a housing 1 bearing on rails 3 by means of guiding rollers 29.

The housing 1 is constructed of any material able to withstand the temperature and pressure conditions when the dryer is operated. This housing 1 has a parallelipepidal shape with a flat roof 4 from which project vents 5. A pair of doors 6 are mounted at each lateral end of the housing. A door 7 is provided at one of the longitudinal sides of the housing 1.

At the lower part of each longitudinal side is mounted a wheel 8 actuated by a motor reducer 9. Provision is also made for a motor 10 cooperating with a gear-box 11 which actuates a coupling bar 12 intended to drive lifting jacks. Further a sealing means, not shown in FIG. 1, is provided between the lower edge of the housing and the ground which is, for instance, a concrete slab 32. Stacks of lumber 13 are positioned in the housing. Each stack of lumber is separated from the adjacent superposed one by means of spacers 14.

Figure 3:
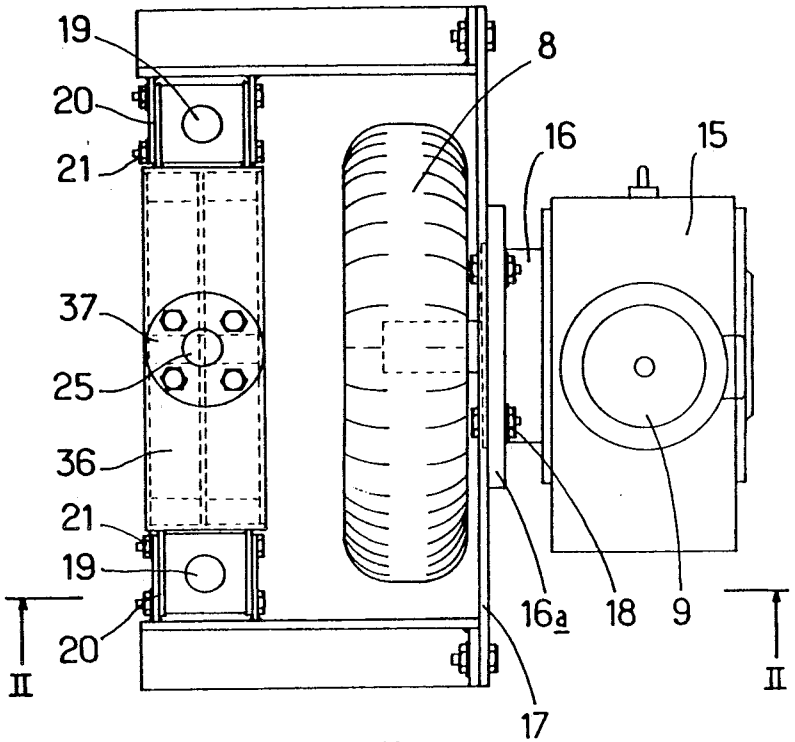
FIG. 3 is a top elevational view of the rolling and motor means of FIG. 2, taken along line II—II in FIG. 2.
Figure 2:
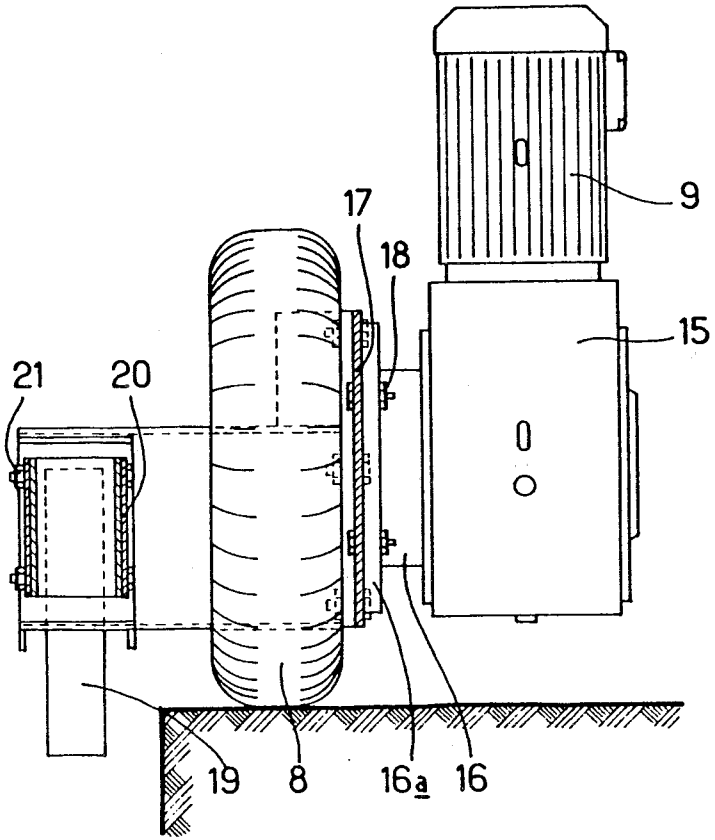
FIG. 2 is a front elevational view of the rolling and motor means.

Referring now to FIGS. 2 and 3, motor reducer 9 is coupled to a gear-box 15 from which projects a driving shaft 22, the housing 16 of which is affixed to the frame 17 of housing 1 by means of bolts 18 intended to couple the frame 17 to an end plate **16*a* integral with the shaft housing 16. The housing when at rest is also supported by brackets 19 affixed to the housing frame and slidable into bushing plates 20 secured to each other by bolts 21. The driving shaft 22 directly drives inflatable wheel 8**.

Figure 5:
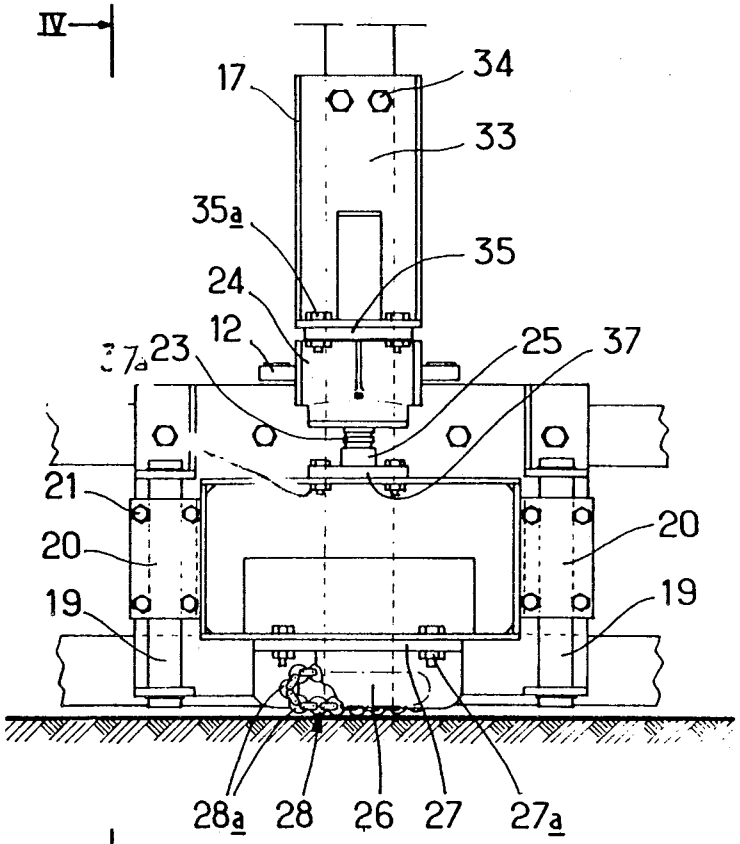
FIG. 5 is a top elevational view partially broken away of the lifting and guiding means of FIG. 4, taken along line V—V in FIG. 4.
Figure 4:
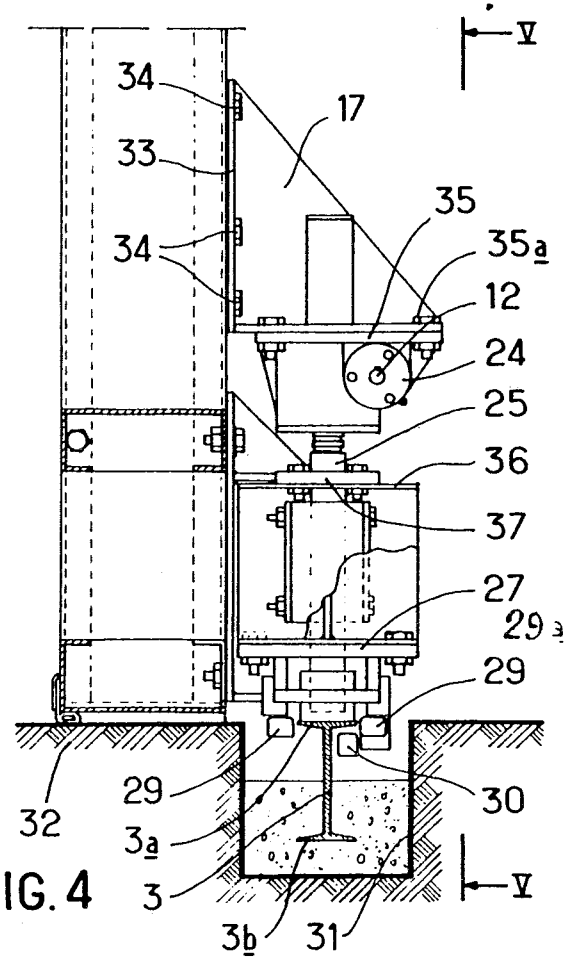
FIG. 4 is a front elevational view partially broken away of the lifting and guiding means; taken along line IV—IV in FIG. 5.

As shown in FIGS. 4–5, coupling bar 12 meshes with the worm portion 23 of a jack 24 by means of a gear wheel (not shown). Worm portion 23 is made integral with pushing shaft 25 having an end portion **25*a* secured to the roller housing 26 and pressing through casing 36 secured to frame 17 by means of a plate 37 to which it is affixed by bolts 27. Within roller housing 26 is mounted a roller chain 27 consisting of a plurality of rolling elements 28 which bear on rail 3. There are also provided for each roller housing guiding rollers 29 located on each side of the upper rail wing 3*a* and stop rollers 30 located beneath said wing 3*a* with a given clearance which limits upward movement of housing 1. The lower wing 3*b* of rail 3 is sunk into concrete filling the lower portion of a channel 31 provided in the slab 32. The jack assembly 24 is affixed to frame 17 through a bracket 33 secured to the frame 17 by means of bolts 34. A sealing joint 40 is provided between the lower edge of housing 1 and slab 32**.

The dryer of the present invention may be operated as follows:

Two control boards A and B are affixed to housing 1. Control board A is intended to supply power to the heaters, for example steam coils, by means of a motor-valve, and fans (not shown in the drawings). When the dryer has to be displaced along rail 3 upon completion of a drying step, power supplied to control board A is switched to control board B. Lifting means, i.e. the jack assemblies 2 are actuated as to lift up housing 1 from slab 32. Then, doors 6 are opened, and the dryer may be moved by actuating the motor reducer 9 which drives wheel 8. As the dryer moves along a desired distance, provision is made for inductive end-of-travel contacts which cut-off the power supply to motor reducer 9. The lifting assemblies then return the housing to the rest position thereof, and the required power connections are switched back to control board A to perform another drying step in the new location. All of these operations must be validated and control board A and B are so designed as to enable this validations.

Thus the dryer may be displaced, as shown in FIG. 1, from lumber stacks 13 which have been dried to lumber stacks 43 to be dried, without any losses of time.

Control board A includes any usual computer unit to process the drying cycle.

Control board B includes usual switching means to supply power to motors and carry out the validation steps.

What I claim is:

1. A dryer movable on rails secured to a slab in the ground and used for drying lumber products comprising:

a housing movable along the rails and having first roller means including a pair of wheels bearing on the slab, lifting means to lift said housing off of the slab, first motor means mounted on said housing to actuate said lifting means to impart one of an upward and a downward movement to said housing to position said housing in one of a raised and a lowered position respectively, second roller means bearing against the rails and being integral with said lifting means, fan means to circulate air through said housing, heating means to supply a thermic operation gradient to the dryer, control means to control in sequence said first motor means, said fan means and said heating means, enabling said dryer to be moved from a first lowered position to a second lowered position located axially along said rails from said first lowered position, and second motor means controlled by said control means and including a motor reducer mounted on said housing to actuate said first roller means to move said housing along the rails when said housing is in said raised position.

2. The dryer as set forth in claim 1 wherein sealing means are located between the housing frame and the ground.

3. The dryer as set forth in claim 1, wherein the wheels are of the inflatable type.

4. The dryer as set forth in claim 1, wherein the second rolling means consist of a roller chain.

5. The dryer as set forth in claim 1, wherein the second rolling means are associated with guiding and retaining means.

6. The dryer as set forth in claim 5, wherein the guiding and retaining means consist of rollers co-operating with the rails, as to avoid any undesired movement of the housing.

7. The dryer as set forth in claim 1, wherein said housing includes a roof and venting means projecting from said roof.

8. The dryer as set forth in claim 1, wherein sealing means are located between said housing and the ground.

9. A dryer movable on rails secured to a slab in the ground and used for drying lumber products comprising:

a housing movable along the rails and having first roller means including a pair of wheels bearing on the slab, lifting means to lift said housing off of said slab, first motor means mounted on said housing to actuate said lifting means to impart one of an upward and a downward movement to said housing to position said housing in one of a raised and a lowered position respectively, second roller means bearing against the rails and being integral with said lifting means, fan means to circulate air through said housing, heating means to supply a thermic operating gradient to the dryer, second motor means mounted on said housing to actuate said first roller means to move said housing along the rails when said housing is in said raised position, and control means to control in sequence said first motor means, said fan means, said heating means and said second motor means, thereby enabling the dryer to be moved from a first lowered position to a second lowered position located axially along the rails from said first lowered position by raising said frame, moving the frame axially along the rails, and lowering said frame.

* * * * *